US005348284A

United States Patent [19]

Ishihama et al.

[11] Patent Number: 5,348,284

[45] Date of Patent: Sep. 20, 1994

[54] SHEET SUPPLY APPARATUS

[75] Inventors: Hitoshi Ishihama, Mitsukaido; Yasuyoshi Hayakawa, Yokohama; Naoki Asano, Kawasaki; Kenichi Horikoshi, Mitsukaido; Tetsuro Onuki, Iwai; Akihiro Toma, Kanagawa; Masanori Yamagata, Kawasaki, all of Japan

[73] Assignee: Canon Kabushiki Kaisha, Tokyo, Japan

[21] Appl. No.: 111,869

[22] Filed: Aug. 26, 1993

[30] Foreign Application Priority Data

Aug. 31, 1992 [JP] Japan ..... 4-255468
Jul. 29, 1993 [JP] Japan ..... 5-188437

[51] Int. Cl.[5] ..... B65H 1/12

[52] U.S. Cl. ..... 271/160; 271/164; 414/923; 248/612

[58] Field of Search ..... 271/147, 160, 162, 164, 271/171, 241, 220, 223, 224; 414/923; 248/605, 612, 613, 623, 624

[56] References Cited

U.S. PATENT DOCUMENTS 4,030,725 6/1977 Fukui et al. ..... 271/164
4,569,587 2/1986 Miyoshi et al. ..... 271/160 X
5,155,537 10/1992 Komatsu et al. ..... 355/309
5,158,276 10/1992 Toma ..... 271/9
5,201,873 4/1993 Kikuchi et al. ..... 271/9

FOREIGN PATENT DOCUMENTS 2951199 6/1989 Fed. Rep. of Germany .
0052833 4/1980 Japan ..... 271/164
0252539 12/1985 Japan ..... 271/160
62-264139 11/1987 Japan .
0221031 9/1990 Japan ..... 271/162
4323123 11/1992 Japan .

*Primary Examiner*—Robert P. Olszewski
*Assistant Examiner*—Carol L. Druzbick
*Attorney, Agent, or Firm*—Fitzpatrick, Cella, Harper & Scinto

[57] ABSTRACT

The present invention provides a sheet supply apparatus comprising a sheet containing device for containing a plurality of sheets, a sheet positioning member provided in the sheet containing device to position the sheets in a widthwise direction thereof by abutting against a side edge of the contained sheets, and a supply device for feeding out the sheets positioned by the sheet positioning member. Wherein the sheet positioning member is previously inclined at a predetermined angle toward a direction opposite to a direction that the sheet positioning member may be inclined by the deflection of the sheet containing device due to the weight of the sheets contained in the sheet containing device.

16 Claims, 7 Drawing Sheets

SHEET SUPPLY APPARATUS

BACKGROUND OF THE INVENTION

1. Field of the Invention

The present invention relates to a sheet supply apparatus used with an image forming apparatus such as a printer, facsimile machine, copying machine and the like and adapted to supply a sheet from a sheet containing device containing sheets such as originals, recording sheets or the like.

2. Description of the Related Art

In conventional sheet supply apparatuses used with image forming apparatuses such as printers, for example, a sheet cassette as a sheet containing device containing a plurality of sheets can be removably mounted to the apparatus and a sheet can be supplied from the mounted sheet cassette to an image forming station for forming an image by a sheet supply roller.

An example of such conventional sheet supply apparatuses is shown in FIG. 8. The conventional sheet supply apparatus will be explained with reference to FIG. 8.

A sheet supply apparatus A is arranged below an image forming apparatus B. The sheet supply apparatus A is designed so that a sheet cassette (sheet containing device) 1 for containing sheets can be mounted between two opposed side walls of a body 2 of the apparatus. Support portions 2*a*, 2*b* for guiding the insertion of the sheet cassette 1 into the body 2 and for supporting the sheet cassette 1 are protruded from and formed on the side walls of the body 2.

Further, the sheet cassette 1 comprises a box-shaped cassette body 6, a pivotable intermediate plate 16 on which a plurality of sheets are stacked, and pressure springs 15 for biasing the intermediate plate 16 toward a sheet supply roller 11 to urge the sheet stack P against the sheet supply roller 11. The cassette body 6 is provided with engagement portions 6*a*, 6*b* protruded outwardly from side walls thereof. By engaging these engagement portions 6*a*, 6*b* with the support portions 2*a*, 2*b* of the body 2 of the sheet supply apparatus, the sheet cassette 1 is removably guided into the body 2.

Incidentally, a positioning guide 17 is formed on an undersurface of a partition 2*c* of the body 2, which positioning guide 17 serves to position the sheet cassette 1 with respect to the body 2 of the sheet supply apparatus in a widthwise direction of the sheet (left and right direction in FIG. 8) by engaging a guide projection 6*c* formed on the cassette body 6 with the positioning guide 17.

A sheet positioning member 3 for regulating one side edge of the sheet stack P to position the sheet stack in the widthwise direction of the sheet is secured to a bottom of the cassette body 6, and a sheet urging member 9 for biasing the sheet stack on the intermediate plate 16 against the sheet positioning member 3 is provided on an auxiliary positioning member 5 at an opposite side. The sheet urging member 9 may comprise a plate-shaped member biased by a spring to urge the sheet stack P, or may comprise a leaf spring for urging the sheet stack directly as shown in FIG. 8.

According to this sheet positioning arrangement, the sheet stack P is positioned with respect to the cassette body 6 in the widthwise direction of the sheet, by urging one side edge of the sheet stack P on the intermediate plate 16 by the sheet urging member 9 so that the other side edge of the sheet stack is abutted against the sheet positioning member 3.

In this way, the sheet stack P is positioned with respect to the cassette body 6 in the widthwise direction of the sheet by the sheet positioning member 3 and the sheet urging member 9, and, further, the cassette body 6 is positioned with respect to the body 2 of the sheet supply apparatus in the widthwise direction of the sheet by the positioning guide 17 of the body 2 and the guide projection 6*c* of the cassette body 6. Accordingly, the sheet stack P is positioned with respect to the body 2 of the sheet supply apparatus in the widthwise direction of the sheet.

However, the above-mentioned conventional sheet supply apparatus has the following disadvantages.

Since the sheet positioning member 3 is secured to the bottom of the cassette body 6 so that it extends perpendicularly to the bottom, when the sheets are stacked in the sheet cassette, the bottom of the cassette body 6 is flexed or deformed by the weight of the sheets, with the result that the sheet positioning member 3 is inclined as shown in FIG. 8. That is to say, the sheet positioning member 3 for positioning the sheet stack P in the widthwise direction of the sheet is inclined in accordance with the amount of sheets P stacked on the intermediate plate 16 to change the perpendicularity of the member 3 greatly. As a result, the sheet stack P is positioned by abutting one side edge of the sheet stack against the inclined sheet positioning member 3.

Accordingly, when the amount of the sheets P stacked in the sheet cassette is little, since the deformation of the bottom of the cassette body 6 is also small, the sheets P can be supplied at the predetermined widthwise position. However, if the amount of the sheets P stacked in the sheet cassette is large, the deformation of the bottom of the cassette body 6 is also large, and, accordingly, the sheet positioning member 3 is inclined greatly, with the result that the widthwise position of the positioned sheet stack is considerably offset from the predetermined position, thus making the correct positioning impossible.

Incidentally, if the deformation of the bottom of the cassette body 6 is suppressed, the above problem can be eliminated. However, to achieve this, if the rigidity of the cassette body 6 is increased, the weight of the sheet cassette will be increased to make the handling of the cassette difficult, to make the construction complicated and to make the cassette expensive.

SUMMARY OF THE INVENTION

The present invention aims to eliminate the above-mentioned conventional drawbacks, and an object of the present invention is to provide a sheet cassette wherein sheets can be always positioned correctly in a widthwise direction of the sheet regardless of the mount of sheets stacked in the cassette and which is inexpensive, light-weight and simple.

To achieve the above object, according to the present invention, there is provided a sheet supply apparatus comprising sheet containing means for containing a plurality of sheets, a sheet positioning member provided in the sheet containing means to position the sheets in a widthwise direction of the sheet by abutting against side edges of the contained sheets, and supply means for feeding out the sheets positioned by the sheet positioning member. Wherein, the sheet positioning member has been previously inclined at a predetermined angle toward a direction opposite to a direction that the sheet positioning member may be inclined by the deformation of the sheet containing means due to the weight of the sheets contained in the sheet containing means.

With this arrangement, since the sheet positioning member has been previously inclined at the predetermined angle, when the sheet containing means is deformed by the weight of the sheets contained in the sheet containing means, the sheet positioning member is shifted to a proper positioning position, thereby positioning the sheets correctly.

Consequently, it is possible to supply the sheets correctly without the skew-feed of the sheet and the deviation of the sheet in the widthwise direction of the sheet.

DETAILED DESCRIPTION OF THE PREFERRED EMBODIMENTS

A first embodiment of the present invention will be explained with reference to FIGS. 1 to 5.

Figure 1:
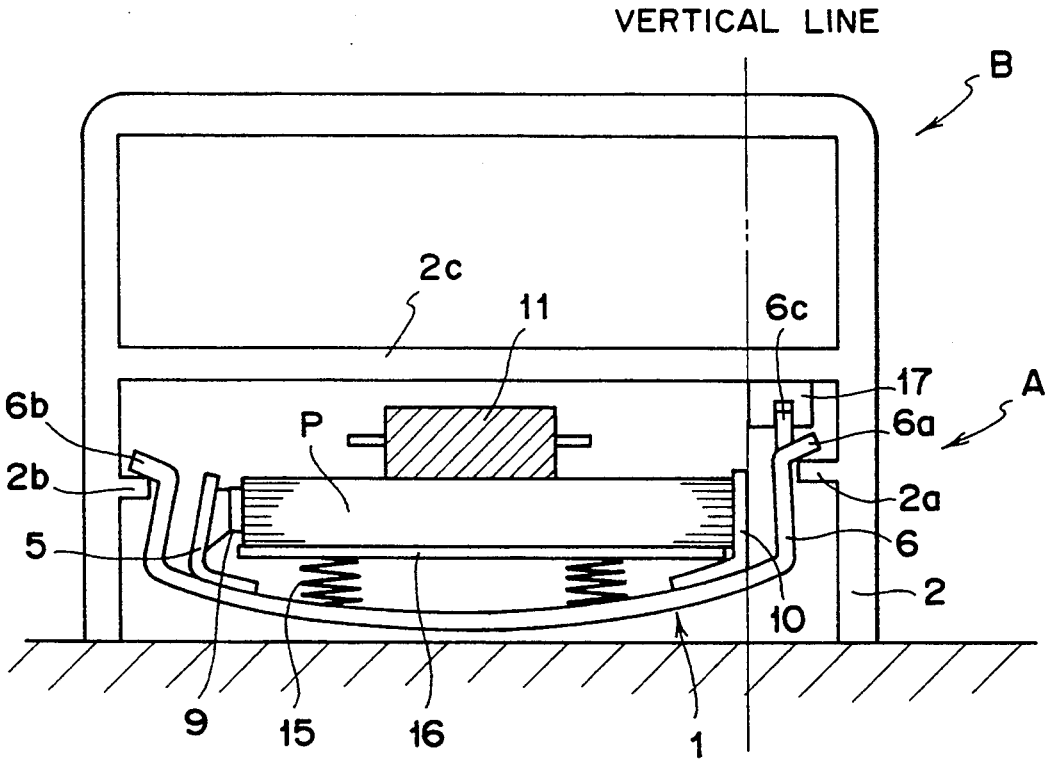
FIG. 1 is an elevational sectional view of a sheet supply apparatus according to a first embodiment of the present invention.
Figure 2:
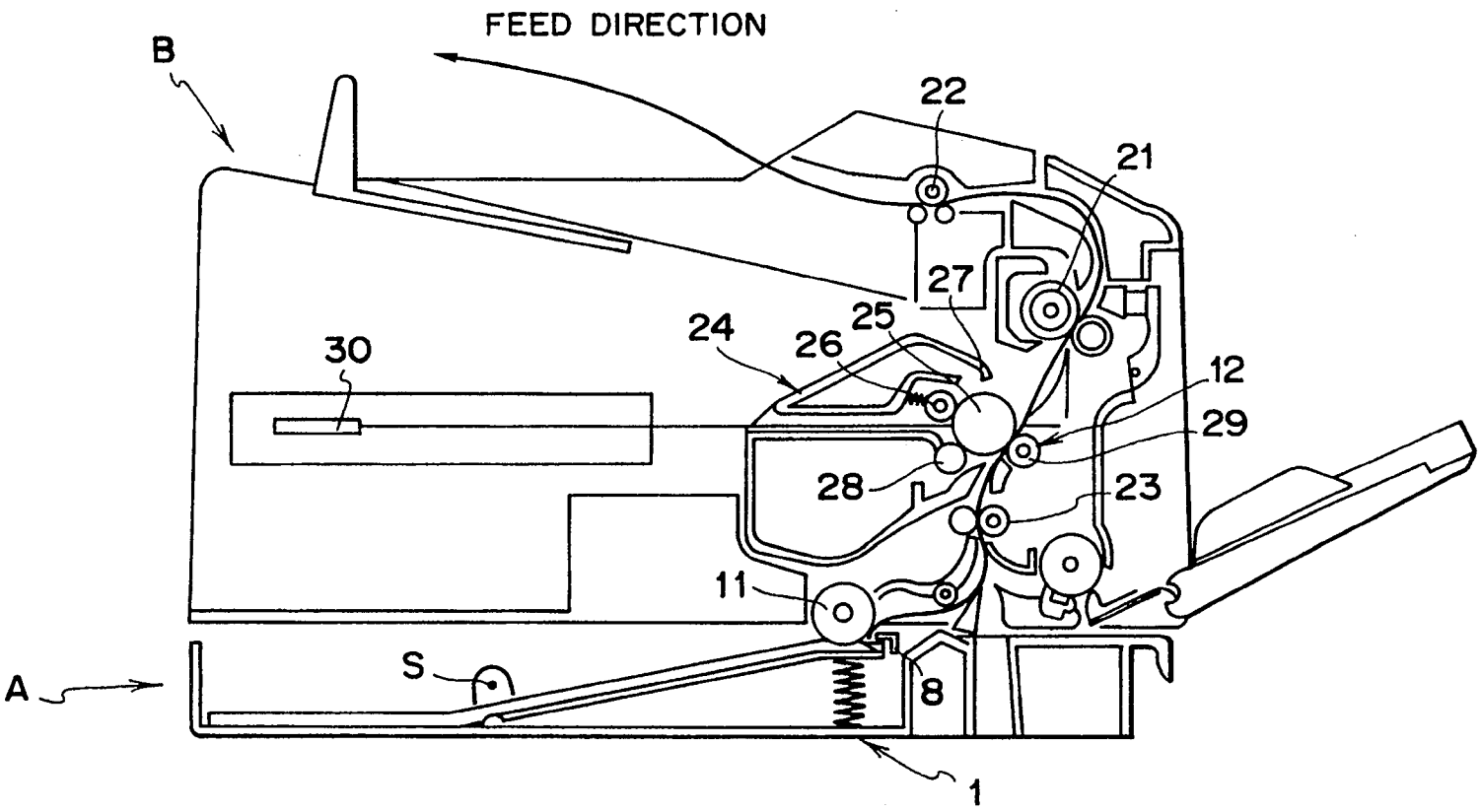
FIG. 2 is an elevational sectional view of a laser beam printer having the sheet supply apparatus of FIG. 1.

FIG. 1 is an elevational sectional view of a sheet cassette (sheet containing means) 1 mounted to a sheet supply apparatus A according to a first embodiment of the present invention, and FIG. 2 is an elevational sectional view of a laser beam printer (image forming apparatus) B having the sheet supply apparatus A according to the first embodiment. Incidentally, regarding elements the same as those explained in connection with the above-mentioned prior art, they are designated by the same reference numerals and a detailed explanation thereof will be omitted.

The construction of the laser beam printer B having the sheet supply apparatus A according to the first embodiment will be briefly explained with reference to FIG. 2.

The sheet supply apparatus A is arranged below the laser beam printer B, and the sheet cassette 1 can be removably mounted to the sheet supply apparatus A. Sheets P stacked in the sheet cassette 1 are fed out by a sheet supply roller 11 from an uppermost one successively. The fed sheets are separated one by one by a separating claw. Incidentally, in the illustrated embodiment, while the sheets are separated one by one by the separating claw, other separating means such as separating means utilizing a friction pad or a separating means utilizing reverse rotation roller may be used.

Within a body of the laser beam printer B, there are arranged a feed roller 23 for feeding the sheet P supplied from the sheet supply apparatus A, an image forming station 12 for transferring a toner image onto the sheet P fed by the feed roller 23 at a predetermined timing, thereby forming an image, a fixing station 21 for fixing the toner image transferred at the image forming station 12 to the sheet P, and discharge rollers 22 for discharging the sheet to which the image was fixed.

Further, a process cartridge 24 disposed at the image forming station 12 includes therein a photosensitive drum (image bearing member) 25, a charger means 26 for charging a surface of the photosensitive drum 25, developing means 27 for forming the toner image on the photosensitive drum 25, and cleaning means 28 for removing the residual toner remaining on the surface of the photosensitive drum 25. The toner image formed on the photosensitive drum 25 is transferred onto the sheet P conveyed by a transfer roller 29. Incidentally, the photosensitive drum 25 is exposed by a scanner portion 30.

Next, the construction of the sheet cassette 1 mounted to the sheet supply apparatus A will be explained.

Figure 5:
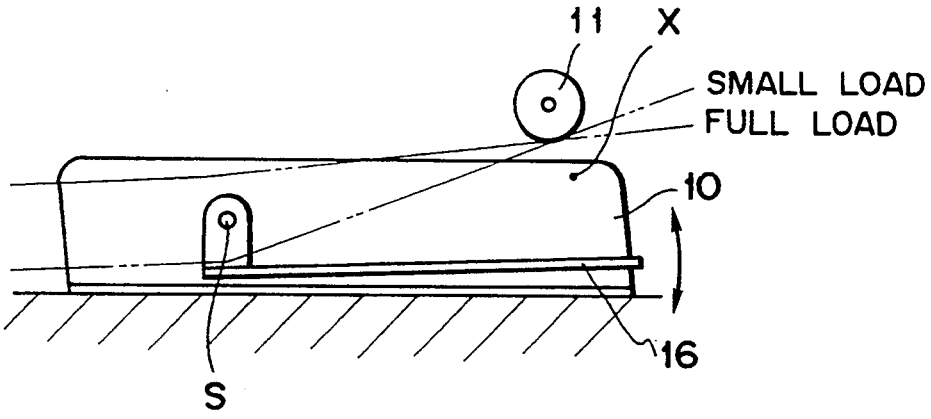
FIG. 5 is a view showing a relation between an intermediate plate and the sheet positioning member of the sheet supply apparatus of FIG. 1.

In FIG. 1, an intermediate plate 16 on which the sheets P are stacked is pivotally arranged in a cassette body 6 of the sheet cassette 1. Further, within the cassette body 6, a sheet positioning member 10 for regulating a position of one edge of the sheet stack P to position the sheet stack P in a widthwise direction of the sheet is secured to a bottom of the cassette body 6, and, in opposition to the sheet positioning member (with the interposition of the sheet stack), there is disposed a sheet urging member 9 for biasing the sheet stack toward the sheet positioning member 10. The sheet urging member 9 comprises a leaf spring for urging the sheet stack P against the sheet positioning member 10. As shown in FIG. 2, a pivot axis S for the intermediate plate 16 is disposed substantially at a central position in a sheet feeding direction within a sheet containing zone in the cassette body 6, and a length of the sheet positioning member 10 in the sheet feeding direction extends from the proximity of the tip end of the intermediate plate 16 to a point behind the pivot axis S as shown in FIG. 5.

Figure 3:
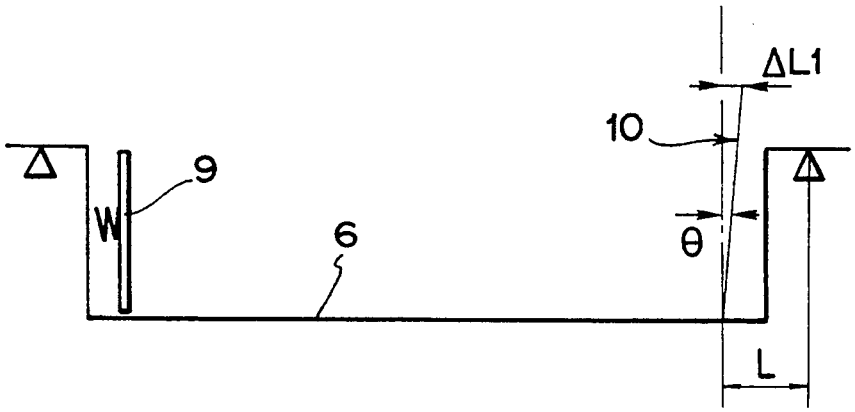
FIG. 3 is a schematic view showing a sheet positioning member of the sheet supply apparatus of FIG. 1 in a condition where no sheet is stacked.

When the sheets P stacked on the intermediate plate 16 is in a full load condition, a central portion of the bottom of the cassette body 6 is deformed downwardly as shown in FIG. 1 by the weight of the sheets P. As explained in connection with the prior art, if the sheet positioning member 10 is vertically secured to the bottom of the cassette body 6, since the sheet positioning member is inclined inwardly when the cassette body 6 is deformed, in the illustrated embodiment, as shown in FIG. 3, the sheet positioning member 10 is secured to the bottom of the cassette body 6 in such a manner that it has been previously inclined outwardly, thereby correcting the inward inclination of the sheet positioning member 10 due to the deformation of the cassette body 6.

Figure 9:
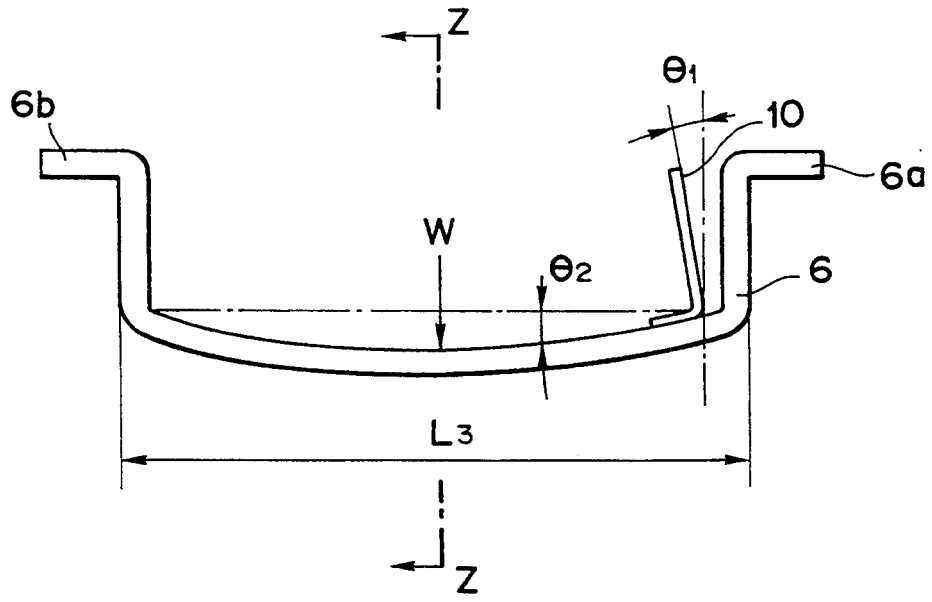
FIG. 9 is a modelling view for calculating a deformation angle when the sheets are fully stacked in the conventional sheet supply apparatus.

An angle of the inward inclination of the sheet positioning member 10 due to the deformation of the cassette body 6 in the sheet full load condition is determined as follows. As shown in FIG. 9, it is assumed that the bottom of the cassette body 6 is a beam. It is considered that the beam is supported at its both ends and a concentrated load W acts on the center of the beam. When the inclination angle of the sheet positioning member 10 is $\theta_1$, a slope of the beam is $\theta_2$ (rad), the elastic modulus of the material forming the bottom of the cassette body 6 is E, the geometrical moment of inertia of the beam is Iz, the load is W and a length of the beam is $L_3$, the following relation is established:

$$\theta_2 = WL_3^2/16EIz \quad (1)$$

However, since the configuration of the bottoms of the cassette bodies 6 differ from each other individually, the slope angle $\theta_2$ obtained from the above equation (1) is not always an actually measured value. Thus, in preferential consideration of the actually measured value, a method for setting the slope angle $\theta_2$ will now be described.

Figure 10:
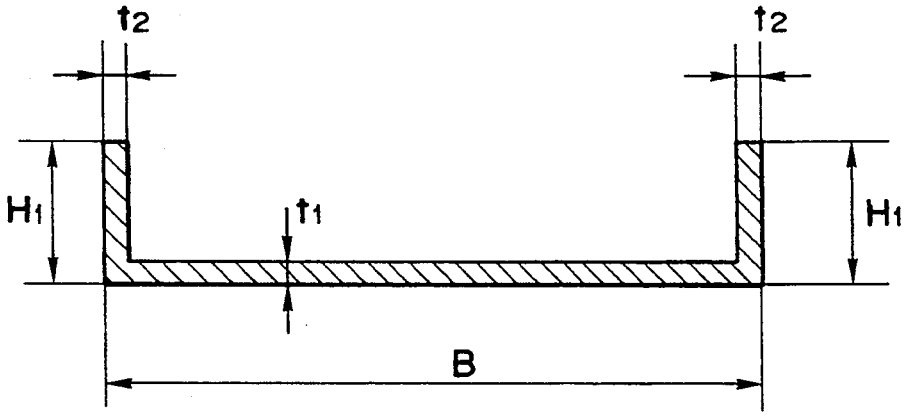
FIG. 10 is a sectional view taken along the line Z—Z of FIG. 9.

In FIG. 9, it is assumed that the whole length of the bottom (beam) $L_3$ is 300 mm, the elastic modulus E of the bottom is 105 to 320 Kg/mm$^2$ and the load W acting on the bottom is 5 Kg. Further, FIG. 10 is a sectional view taken along the line Z—Z of FIG. 9, in which a height $H_1$ of each side wall of the cassette body 6 is 35 mm, a thickness $t_2$ of each side wall is 1.5 mm, the whole width B of the cassette body is 370 mm and a thickness $t_1$ of the bottom is 2 mm. The geometrical moment of inertia Iz of this configuration (section) can be sought from the following equation:

$$Iz = \{t_1^3(B-2t_2)/12\} + 2\{(t_2H_1^3)/12\}.$$

Accordingly, from the above equation (1), the slope angle $\theta_2$ becomes as follows:

In case of $E$ = 320 Kg/mm$^2$ $\theta_2$ = 0.008 rad = 0.5°;

In case of $E$ = 105 Kg/mm$^2$ $\theta_2$ = 0.024 rad = 1.4°.

Next, a test result regarding the actual measurement of the slope angle $\theta_2$ is shown, when the sheets P was in the full load condition, the weight W was 5 Kg and the inclination angle $\theta_1$ of the sheet positioning member 10 was 1.33°.

Now, in comparison with the calculated value and the actually measured value, the slope $\theta_2$ (=1.4°) in case of the elastic modulus E=105 Kg/mm$^2$ is closer to the actually measured value $\theta_1$=1.33°. Thus, in the illustrated embodiment, the elastic modulus of the bottom of the cassette body 6 is set to E=105 Kg/mm$^2$.

By setting the slope angle $\theta_2$ and correcting the inclination angle $\theta_1$ in this way, when the sheets P in the cassette body 6 are in the full load condition, the sheet positioning member 10 becomes perpendicular to a horizontal direction as shown in FIG. 1 so that even when the cassette body 6 is deformed the uppermost sheet P can be correctly positioned at the predetermined position.

Now, in order to easily understand the principle of the present invention, the present invention will be explained while comparing it with the prior art.

Figure 11:
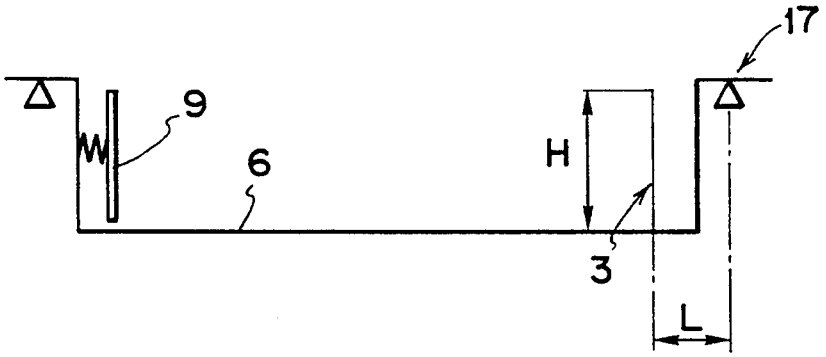
FIG. 11 is a schematic view showing a sheet positioning member of the conventional sheet supply apparatus in a condition where no sheet is stacked.
Figure 12:
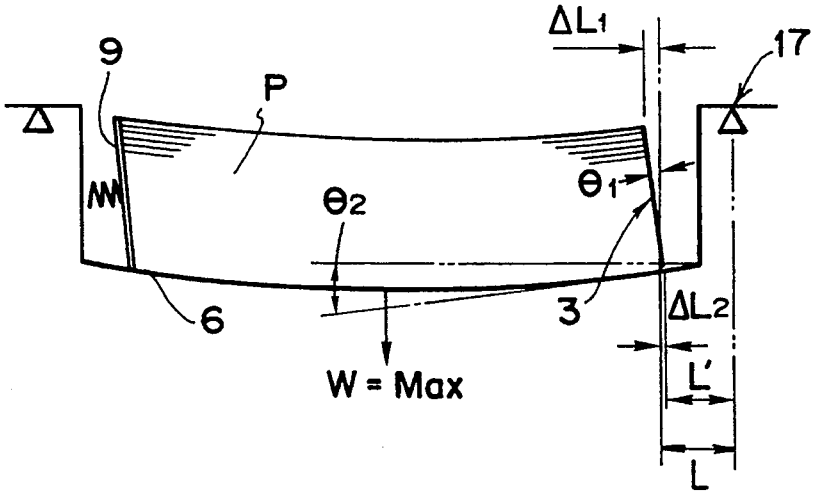
FIG. 12 is a schematic view showing a sheet positioning member of the conventional sheet supply apparatus in a condition that sheets are fully stacked.

FIG. 11 is a schematic view of the conventional sheet cassette 1 in a condition that no sheet P is contained in the cassette body 6. It is assumed that a distance between the positioning guide 17 and the sheet positioning member 3 in a sheet empty condition is L and a height from a lower end of the sheet positioning member 3 at the bottom of the cassette body 6 to the upper surface of the sheet stack in the sheet full load condition is H. Further, FIG. 12 is a schematic view of the sheet cassette in the sheet full load condition. In this condition, when it is assumed that a deviation of the uppermost sheet is $\Delta L_1$, a distance between the positioning guide 17 and the lower end of the sheet positioning member is L', the slope of the cassette body 6 at the lower end of the sheet positioning member 3, i.e., the inclination angle of the sheet positioning member 3 is $\theta_1$ and a positional deviation of the lower end of the sheet positioning member 3 is $\Delta L_2$, a relation between the deflection of the cassette body 6 and the positional deviation will be briefly as follows:

$$\Delta L_1 = H \sin\theta_1 - \Delta l_2 \quad (2)$$

$$\Delta L_2 = L - L' = (1 - \cos\theta_1) \quad (3)$$

Accordingly, from the equations (2) and (3), the following relation is obtained:

$$\Delta L_1 = H \sin\theta_1 - (1 - \cos\theta_1) \quad (4)$$

Although the values $\theta_1$, H and L are changed in accordance with the dimension of the sheet cassette, material of the sheet cassette and the number of sheets P stacked in the cassette, as an example, when it is assumed that $\theta_1$=1.5°, H=35 mm and L=20 mm, in the sheet full load condition, the positional deviation $\Delta L_1$ of the sheet will be as follows from the above equation (4):

$$\Delta L_1 = 35 \sin 1.5 - (1 - \cos 1.5) = 0.92 \text{ mm}.$$

Thus, the copying accuracy of the sheet P is deviated from the reference by 0.92 mm.

Next, the sheet cassette 1 according to the illustrated embodiment will be similarly considered.

Figure 4:
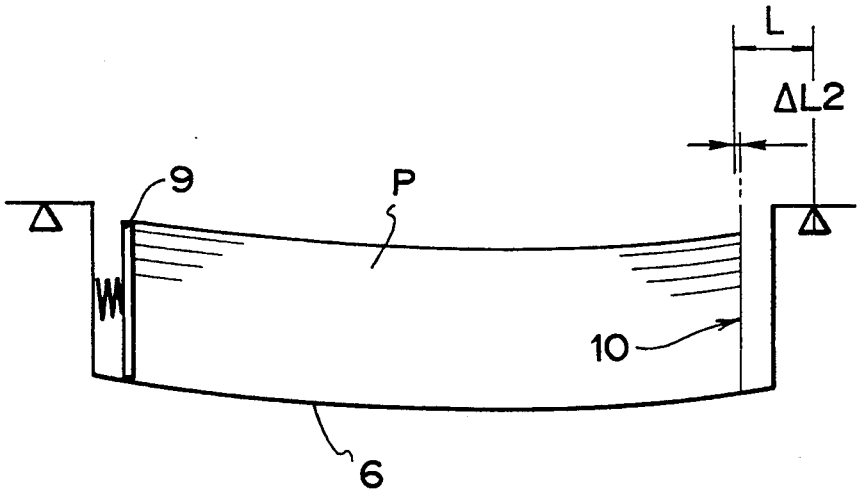
FIG. 4 is a schematic view showing a sheet positioning member of the sheet supply apparatus of FIG. 1 in a condition where sheets are fully stacked.

FIG. 3 is a schematic view of the sheet cassette 1 according to the illustrated embodiment in the sheet empty condition, and FIG. 4 is a schematic view of the sheet cassette 1 according to the illustrated embodiment in the sheet full load condition. As shown in FIG. 3, in the sheet empty condition, the sheet positioning member 10 has been previously inclined outwardly by $\Delta L_1$ (H sin $\theta$).

Further, when the sheets on the intermediate plate 16 are in the full load condition as shown in FIG. 5, since the sheet positioning member 10 was previously inclined outwardly by $\Delta L_1$ (H sin $\theta$), as shown in FIG. 3, the upper end of the sheet positioning member 10 assumes substantially a vertical position. Accordingly, when the positional deviation of the sheet in the sheet full load condition is $\Delta L_1'$, the following relation is obtained:

$$\Delta L_1' = \Delta L_2 = L - L' = (1 - \cos\theta) \quad (5)$$

As in the aforementioned example, when it is assumed that $\theta_1=1.5°$, H=35 mm and L=20 mm, the positional deviation $\Delta L_1'$ of the sheet in the sheet full load condition will be:

$$\Delta L_1'=20(1-\cos 1.5)=0.007 \text{ mm.}$$

Accordingly, in comparison with the positional deviation in the conventional sheet cassette 1, it can be seen that it is possible to suppress the positional deviation considerably.

When the sheets P in the cassette body 6 are successively supplied and the amount of the sheets stacking in the cassette is reduced, since the total weight of the sheets is decreased, the deflection amount of the cassette body 6 is also reduced, and, accordingly, the inclination angle of the sheet positioning member 10 is also decreased. As a result, the sheet positioning member 10 in which the inclination angle $\theta$ was previously corrected is gradually inclined outwardly. However, as shown in FIG. 5, in a small sheet load condition, since the height of the sheet stack P is decreased, at a rearward position (horizontal portion) from the center, the sheets P are positioned in the widthwise direction of the sheet by the lower portion (root portion) of the sheet positioning member 10. Thus, when the amount of the sheets P becomes small, even if the sheet positioning member 10 is inclined inwardly, since the sheets P are positioned in the widthwise direction of the sheet by the lower portion of the sheet positioning member 10, i.e., by a portion (of the sheet positioning member) the inclination amount of which is little, it is possible to prevent the positional deviation of the sheets. In this way, from the fully loaded sheets to the last sheet, the sheets can be supplied at the correct reference position without causing the positional deviation in the horizontal direction.

Next, the change in the slope due to the variation of the sheet stacking amount and the change of the sheet positioning member 10 due to the change in the slope will be explained while comparing the calculated value with the actually measured value.

In FIGS. 9 and 10, when $L_3=300$ mm, E=105 Kg/mm$^2$, $H_1=50$ mm, $t_2=1.5$ mm, B=370 mm and $t_1=2$ mm, the slope angles $\theta_2$ are calculated by using the equation (1) regarding $W_1=5$ Kg (full load), $W_2=3$ Kg (middle load) and $W_3=1$ Kg (small load), and the deviations $\Delta L_1$ are calculated by using the equation (4).

In this case, when $\Delta L_1$ is zero in case of $W_3=1$ Kg (small load), the changed amount of $\Delta L_1$ in case of $W_2=3$ Kg (middle load) becomes Δ0.49 mm and the changed amount of $\Delta L_1$ in case of $W_1=5$ Kg (full load) becomes Δ0.98 min. These calculated values, and the actually measured values obtained from the test effected by using the sheet cassette set according to the above-mentioned condition are shown in the following Table 1.

Incidentally, the measurement was effected by measuring the changed amount at an upper position X of the sheet positioning member 10 shown in FIG. 5.

TABLE 1

(unit: mm)

| Condition | Small load (only one sheet) | Middle load | Full load |
|---|---|---|---|
| Calculated value | 0 | −0.49 | −0.98 |
| Positioning member (no countermeasure) | 0 | −0.6 | −1.1 |
| Positioning member (with countermeasure) | * +0.9 | * +0.5 | 0 |

TABLE 1-continued (unit: mm)

Incidentally, the values shown by * are changed amounts at the upper position X of the sheet positioning member 10 shown in FIG. 5, and, when the sheets are actually supplied in the small load and middle load conditions, as mentioned above, since the sheets P are positioned by the lower portion (root portion) of the sheet positioning member at a rear position from the center, the change of the sheet positioning member 10 in the plus (+) direction does not influence the actual position of the sheets P, and, in the full load condition, the sheet positioning member almost does not change.

Accordingly, as shown in the above Table 1, it can be seen that, as similar to the calculated values, also from the actually measured values, the sheet positioning member is changed and there is no deviation from the sheet positioning position by using the sheet positioning member with countermeasure.

Further, when the sheets are contained or loaded in the sheet cassette 1, since the sheet positioning member 10 is previously inclined outwardly, the sheet loading operability into the sheet cassette can be improved.

Figure 6:
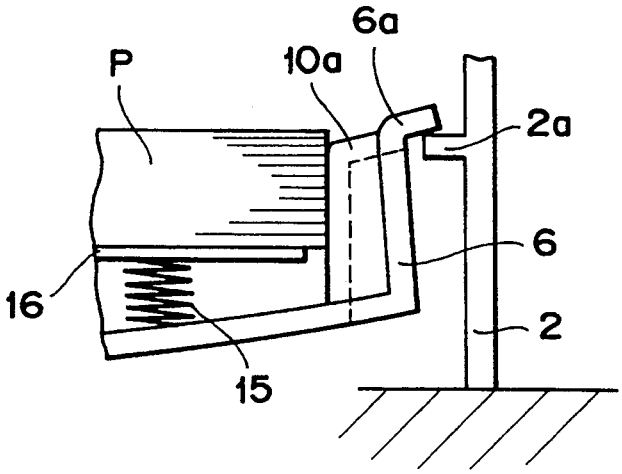
FIG. 6 is an elevational sectional view of a main portion of a sheet supply apparatus according to a second embodiment of the present invention.

Next, a second embodiment of the present invention will be explained with reference to FIG. 6 which is a partial front view of a sheet cassette 1 having a sheet positioning member 10*a* integrally formed with a cassette body 6, in place of the sheet positioning member 10 of the first embodiment.

By previously inclining the sheet positioning member 10*a* outwardly by an amount corresponding to the inward inclination of the sheet positioning member 10*a* caused by the deflection (deformation) of the cassette body 6 due to the weight of the sheets fully loaded in the cassette body 6, it is possible to correct the positional deviation due to the inward inclination of the sheet positioning member. In this embodiment, it is possible to prevent the positional deviation of the sheets P due to the deflection of the cassette with a more simplified construction and lighter weight than the first embodiment.

Next, a third embodiment of the present invention will be explained with reference to FIG. 7.

Figure 7:
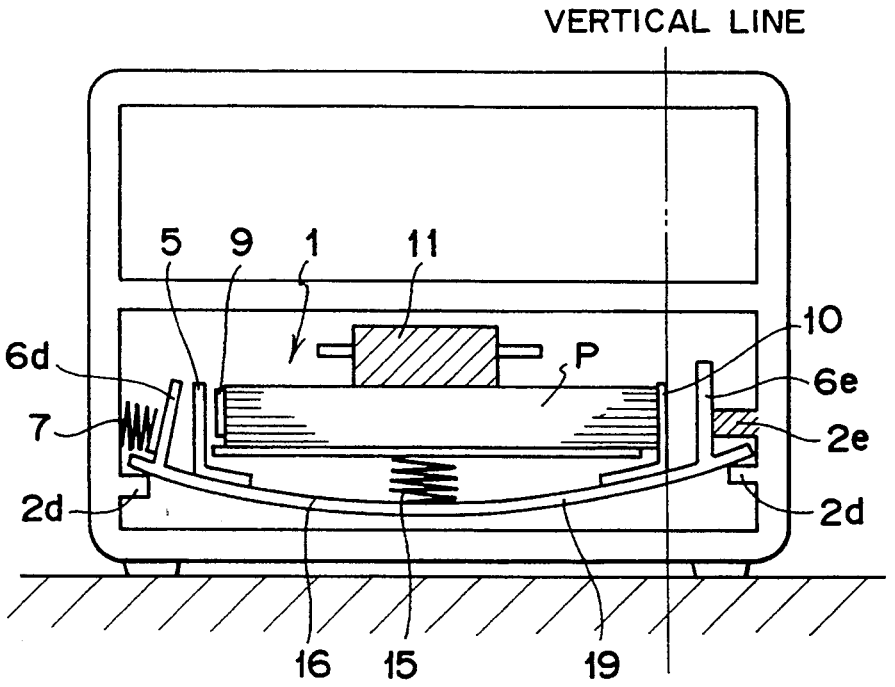
FIG. 7 is an elevational sectional view of a sheet supply apparatus according to a third embodiment of the present invention.
Figure 8:
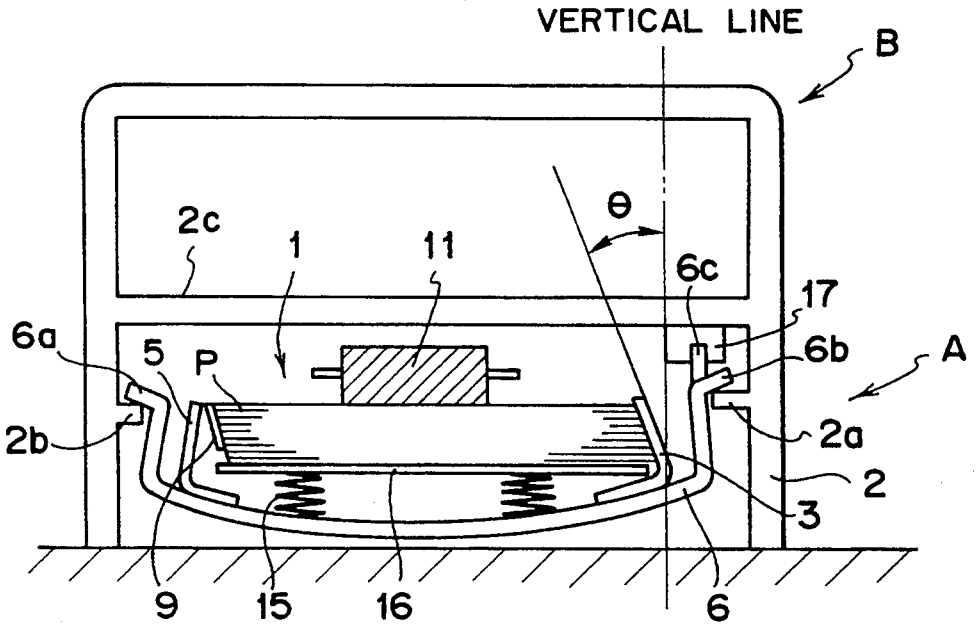
FIG. 8 is an elevational sectional view showing an example of a conventional sheet supply apparatus.

In FIG. 7, a cassette body 6 of a sheet cassette 1 is supported by a body 2 of a sheet supply apparatus by resting both extensions extending outwardly from both ends of a bottom of the cassette body on support members 2*d* of the body 2. A side plate 6*d* of the cassette body 6 is biased by a compression spring 7 so that the other side plate 6*e* is abutted against a rib 2*e* integrally formed with the apparatus body 2, thereby positioning the sheet cassette in a widthwise direction (horizontal direction) of the sheet.

As similar to the first embodiment, the sheets P in the cassette body 6 are stacked on an intermediate plate 16 at their front portions and are urged against a sheet supply roller 11 by pressure springs 15. Further, as similar to the first embodiment, by a sheet positioning member 10, a sheet urging spring 9 for urging the sheet stack P against the sheet positioning member 10 and an auxiliary positioning member 5 for supporting the urging spring, the sheet stack P is positioned in the widthwise direction of the sheet. As similar to the first embodiment, the sheet positioning member 10 is previously inclined outwardly to correct the inward inclination thereof caused by the deflection of the cassette body 6, whereby all of the sheets (from the fully loaded sheets to the last sheet) can be supplied without causing the positional deviation.

With this arrangement, it is possible to simultaneously solve the problems regarding the positional deviation of the sheet cassette 1 in the widthwise direction of the sheet due to the dispersion in the mounting operation of the sheet cassette 1 to the sheet supply apparatus and the positional deviation of the sheet P itself in the widthwise direction of the sheet due to the inclination of the sheet positioning member 10 by the weight of the sheets.

As mentioned above, while the present invention was explained in connection with particular embodiments, the present invention is not limited to such embodiments. For example, in a sheet supply apparatus of a type wherein sheets stacked on a tray are supplied, the present invention can be applied to a sheet positioning member for positioning the sheets stacked on the tray in a widthwise direction of the sheet. In this case, the sheet positioning member is previously inclined to compensate the deflection of the tray caused by the weight of the stacked sheets so that when the sheets are stacked the sheet positioning member is shifted to a vertical condition to position the sheets to the proper position.

Further, in the illustrated embodiments, while the present invention was applied to the sheet supply apparatus for supplying the sheet to the image forming apparatus, the present invention may be applied to an image reading apparatus for reading an image formed on a sheet or a sheet supply apparatus for supplying a sheet on which an image was formed to an image reading portion such as a copying machine.

What is claimed is:

1. A sheet supply apparatus, comprising:

sheet containing means for containing a plurality of sheets;

a sheet positioning member provided in said sheet containing means for positioning the sheets in a widthwise direction thereof by abutting against a side edge of the contained sheets; and supply means for feeding out the sheets positioned by said sheet positioning member;

wherein said sheet positioning member is previously inclined at a predetermined angle toward a direction opposite to a direction where said sheet positioning member may be inclined by deflection of said sheet containing means due to a weight of the sheets contained in said sheet containing means.

2. A sheet supply apparatus according to claim 1, wherein said sheet containing means is removably mounted to a body of the sheet supply apparatus by engaging engagement portions provided on both side portions of said sheet containing means with support portions provided on the body of the sheet supply apparatus.

3. A sheet supply apparatus according to claim 2, wherein said sheet positioning member is previously inclined to assume a vertical position when a maximum amount of sheets are stacked on said sheet containing means.

4. A sheet supply apparatus according to claim 3, wherein said sheet positioning member is provided at one lateral edge of the sheets to position the sheets by regulating said one lateral edge of the sheets urged by a sheet urging member.

5. A sheet supply apparatus according to claim 4, wherein said sheet containing means is provided with a pivotable intermediate plate on which the sheets are stacked, and biasing means for biasing said intermediate plate toward said supply means provided in the sheet supply apparatus, and said sheet positioning member is secured to a body of said sheet containing means to position the sheets stacked on said intermediate plate.

6. A sheet supply apparatus according to claim 5, wherein said sheet positioning member extends rearwardly of a pivot axis for said intermediate plate in a sheet feeding direction.

7. A sheet supply apparatus according to claim 6, wherein the sheets contained in said sheet containing means are fed out in a direction parallel to a mounting direction of said sheet containing means to the sheet supply apparatus.

8. A sheet supply apparatus according to claim 6, further comprising another positioning means for positioning said sheet containing means within the sheet supply apparatus in the widthwise direction of the sheet.

9. A sheet supply apparatus according to claim 8, wherein said positioning means comprises a positioning guide provided on the sheet supply apparatus and having a recess, and a guide projection provided on said sheet containing means to engage with said recess.

10. A sheet supply apparatus according to claim 8, wherein said positioning means comprises a positioning rib provided on one side wall of the sheet supply apparatus, and a spring member for biasing said sheet containing means toward said rib.

11. A sheet supply apparatus, comprising:

sheet containing means for containing a plurality of sheets;

a sheet positioning member provided in said sheet containing means for positioning the sheets in a widthwise direction thereof by abutting against a side edge of the contained sheets; and supply means for feeding out the sheets positioned by said sheet positioning member;

wherein said sheet positioning member is previously inclined at a predetermined angle so that, when said sheet containing means is deflected by a weight of the sheets contained in said sheet containing means, said sheet positioning member assumes substantially a vertical position.

12. A sheet supply apparatus according to claim 11, further comprising sheet urging means for urging the sheets toward said sheet positioning member.

13. A sheet supply apparatus according to claim 12, wherein said sheet containing means comprises a pivotable intermediate plate on which the sheets are supported and stacked, and biasing means for biasing said intermediate plate toward said supply means provided in the sheet supply apparatus, and said sheet positioning member is secured to a body of said sheet containing means to position the sheets stacked on said intermediate plate.

14. A sheet supply apparatus according to claim 13, wherein said sheet positioning member extends rearwardly of a pivot axis for said intermediate plate in a sheet feeding direction.

15. An image forming apparatus, comprising:

sheet containing means for containing a plurality of sheets;

a sheet positioning member provided in said sheet containing means for positioning the sheets in a widthwise direction of the sheet by abutting against side edges of the contained sheets;

supply means for feeding out the sheets positioned by said sheet positioning member; and image forming means for forming an image on the sheet fed out by said supply means;

wherein said sheet positioning member is previously inclined at a predetermined angle toward a direction opposite to a direction that said sheet positioning member may be inclined by deflection of said sheet containing means due to a weight of the sheets contained in said sheet containing means.

16. An image forming apparatus, comprising:

sheet containing means for containing a plurality of sheets;

a sheet positioning member provided in said sheet containing means to position the sheets in a widthwise direction of the sheet by abutting against side edges of the contained sheets;

supply means for feeding out the sheets positioned by said sheet positioning member; and image forming means for forming an image on the sheet fed out by said supply means;

wherein said sheet positioning member is previously inclined at a predetermined angle so that, when said sheet containing means is deflected by a weight of the sheets contained in said sheet containing means, said sheet positioning member assumes substantially a vertical position.

* * * * *

UNITED STATES PATENT AND TRADEMARK OFFICE

CERTIFICATE OF CORRECTION

PATENT NO. : 5,348,284
DATED : September 20, 1994
INVENTOR(S) : HITOSHI ISHIHAMA, ET AL.

It is certified that error appears in the above-indentified patent and that said Letters Patent is hereby corrected as shown below:

Title page, Col. 2, line 6, under Foreign Patent Documnt
Line FPD, "4323123 11/1992 Japan" should read --4-323123 11/1992 Japan--.

Column 2,
Line 55, "mount" should read --amount--.

Column 5,
Line 51, "was" should read --were--.

Column 6,
Line 67, "$\Delta L_1' = \Delta L_2 = L - L' = (1 - \cos\theta)$ (5)" should read --$\Delta L_1' = \Delta L_2 = L - L' = (1 - \cos\theta)$ . . . . . (5)--.

Signed and Sealed this

Twenty-eight Day of February, 1995

*Attest:*

Bruce Lehman

BRUCE LEHMAN

*Attesting Officer*

*Commissioner of Patents and Trademarks*